US005610357A

United States Patent [19]

Frank-Braun

[11] Patent Number: 5,610,357

[45] Date of Patent: Mar. 11, 1997

[54] STRINGED MUSICAL INSTRUMENT PICKUP WITH TWO ELECTROMAGNETIC COIL ASSEMBLIES HAVING TOOTHED CORES

[76] Inventor: Michael Frank-Braun, 147 Rte. 257 South, La Patrie, Quebec, Canada, J0B 1Y0

[21] Appl. No.: 539,819

[22] Filed: Oct. 6, 1995

[51] Int. Cl.[6] ..... G10H 3/18

[52] U.S. Cl. ..... 84/726

[58] Field of Search ..... 84/723, 725, 726, 84/728

[56] References Cited

U.S. PATENT DOCUMENTS

| | | | |
|---|---|---|---|
| 4,026,178 | 5/1977 | Fuller | 84/726 |
| 4,348,930 | 9/1982 | Chobanian et al. | 84/726 |
| 5,292,998 | 3/1994 | Knapp | 84/726 |
| 5,422,432 | 6/1995 | Lace | 84/726 |

*Primary Examiner*—William M. Shoop, Jr.
*Assistant Examiner*—Jeffrey W. Donels
*Attorney, Agent, or Firm*—McCormick, Paulding & Huber

[57] ABSTRACT

An electromagnetic pickup for a guitar or similar stringed musical instrument has two coil and core assemblies adapted to extend across the strings of the associated instrument at different points along the length of the strings, the coil and core assemblies being associated with a permanent magnet means creating magnetic flux circuits through the cores and the strings. Each of the cores is in the form of an elongated strip having teeth vertically extending therefrom with the teeth being equal in number to the strings of the instrument and spaced in conformity with the string spacing so that each tooth of each core can underlie a respective one of the strings. The elongated strip of one core is located adjacent to the strings and that of the other core is located remote from the strings so that somewhat different signals are induced by string vibration in the coils associated with the two different cores. Each core carries two separate coils. The coils of the two cores are connected so as to be series aiding with respect to voltages induced by string vibrations and to be series bucking with relation to voltages induced by stray magnetic fields. The coils are connected to a number of output conductors in such a way as to allow a performer to select for feed to an associated utilization system various different ones or combinations of the signals induced in the individual coils received on the two cores.

7 Claims, 3 Drawing Sheets

STRINGED MUSICAL INSTRUMENT PICKUP WITH TWO ELECTROMAGNETIC COIL ASSEMBLIES HAVING TOOTHED CORES

FIELD OF THE INVENTION

This invention relates to electromechanical pickups or transducers for use on stringed musical instruments such as guitars for producing electrical output signals corresponding to the string vibrations which signals may be amplified, possibly conditioned and modified in various ways, and used to drive speakers to produce a magnified version of the sound generated by the strings; and deals more particularly with such pickups of the electromagnetic type wherein the string vibrations are detected by way of changes in magnetic flux passing through coils which flux changes are caused by the string vibrations.

BACKGROUND OF THE INVENTION

Electromagnetic pickups for stringed musical instruments such as mentioned above are well known in the prior art and have been used for many years with guitars and other stringed musical instruments using strings which are at least in part made of a ferromagnetic material so as to be capable of, when vibrated, generating the magnetic flux changes to which the coil means of the pickup is sensitive.

The general object of this invention is to provide an electromagnetic pickup which is improved in comparison to prior ones and which is of a simple construction using few parts and produces output signals of desirable quality.

A more specific object of the invention is to provide an electromagnetic pickup including a first coil and core section producing electrical signals representing a mixture of the separate vibrations of the individual strings in which mixture the components originating from the individual strings are to a significant degree distinguishable from one another and a second coil and core section producing electrical signals representing a more melded combination of the vibrations of the individual strings with the coil means of the two sections being wound and connected to one another and to output conductors in such a way that the outputs of the two sections are humbucking relative to one another in regard to stray magnetic flux fields and so as to allow a performer to vary the character of the reproduced sound by selecting for feed to the associated sound system the output signal of the first coil and core section, the output of the second coil and core section or an output consisting of a combination of the outputs of the two coil and core sections.

Other objects and advantages of the invention will be apparent from the following detailed description of an electromagnetic pickup embodying the invention.

SUMMARY OF THE INVENTION

The invention resides in an electromagnetic pickup for a guitar or similar stringed musical instrument comprising two coil and core sections, the cores of which sections in cooperation with a permanent magnet means located between the cores form part of a magnetic flux circuit passing through the strings of the instrument, the reluctance of which circuit is varied by the vibrations of the strings to in turn produce flux changes inducing signal voltages in the coil means wound on the two cores, each of the cores of the two coil and core sections being an elongate blade of ferromagnetic material having a plurality of vertically extending teeth horizontally spaced from one another and connected to one another by a horizontally extending strip, the teeth being equal in number to the number of strings of the instrument and spaced from one another in conformity to the spacing of the strings so that the pickup can be located on an instrument with each of the teeth of each of the blades underlying a respective one of the strings.

The invention also resides in the two blades of the pickup being arranged so that in the case of one of the blades the elongated strip is in the upper portion of the blade so as to immediately underlie the strings of the instrument, and so that in the case of the other blade the elongated strip is located at the bottom of the blade so that the free ends of the teeth of that blade are located immediately below the instrument strings.

The invention also resides in that blade in which the elongated strip is in the upper portion of the blade having the upwardly facing surface of the elongated strip shaped so that the spacings of the strings of the instrument from that upwardly facing surface is non-uniform.

The invention also resides in the coil of one of the two coil and core sections being connected to the coil means of the other coil and core sections and to two output conductors in such way that the signals generated in said two coil means by string vibration are in series aiding relationship in respect to the voltage appearing across the two output conductors and so that the voltages induced in said two coil means by stray magnetic fields are in series bucking relationship to one another in respect to the voltage appearing across two output conductors.

The invention also resides in the coil means of the two coil and core sections being connected to further output conductors such that in addition to the combined output of the two coil means which appears across another said above-mentioned two conductors, the voltage produced by the coils means of the first coil and core section appears across another pair of conductors and the voltage produced by the coil of means the other of the two coil and core sections appears across yet another pair of conductors.

The invention also resides in other features and advantages of the invention defined by the following description and claims.

DESCRIPTION OF THE PREFERRED EMBODIMENT

Figure 1:
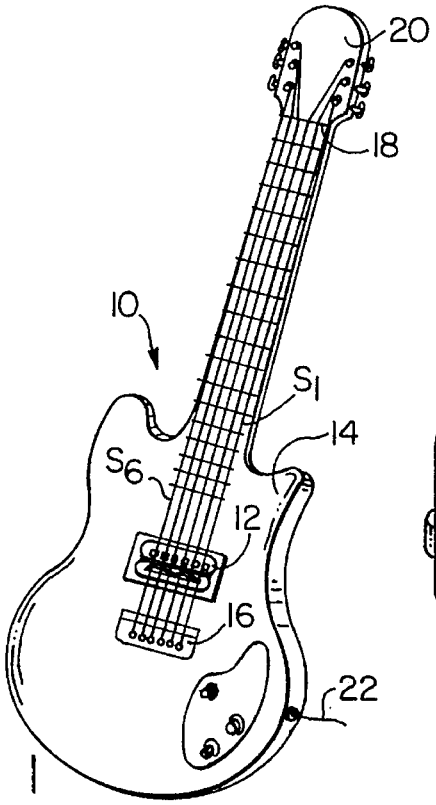
FIG. 1 is a perspective view of a guitar including an electromagnetic pickup embodying the precept invention.
Figure 2:
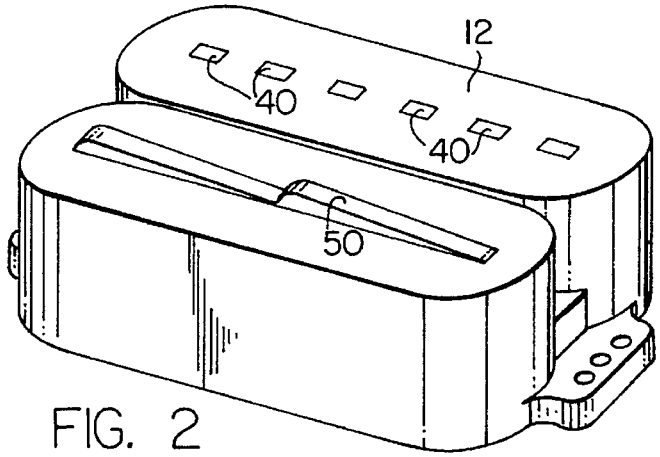
FIG. 2 is a perspective view of the pickup used in the guitar of FIG. 1
Figure 3:
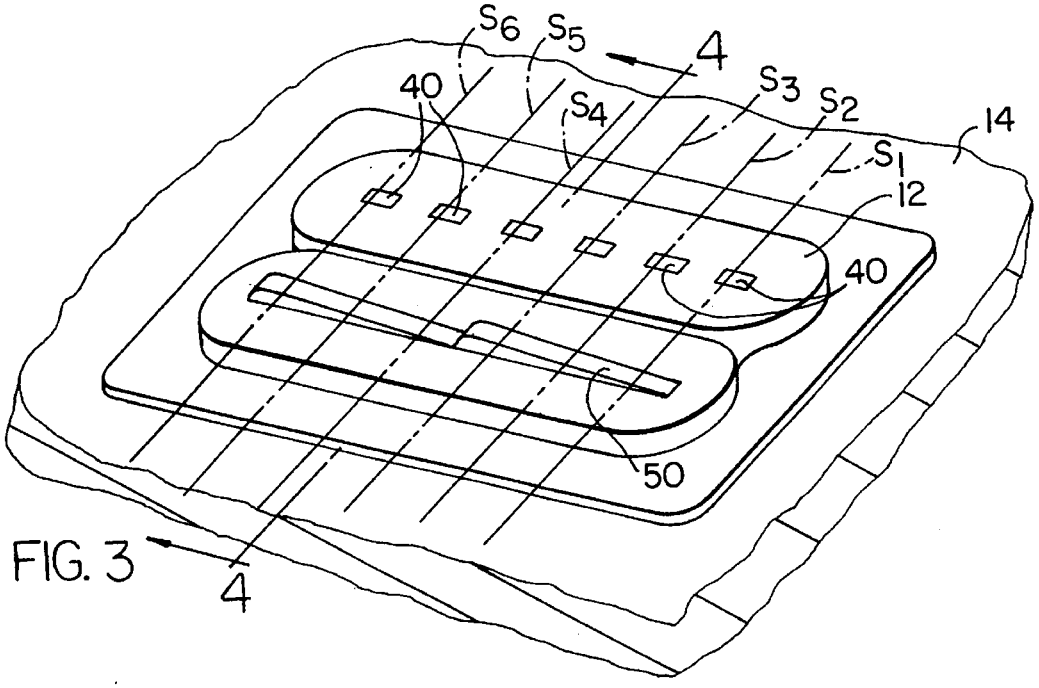
FIG. 3 is a fragmentary enlarged view of a portion of the guitar of FIG. 1 showing more clearly the pickup as mounted in the body of the guitar.

The electromagnetic pickup of this invention is one intended for use with stringed musical instruments, such as guitars; and, by way of example, FIG. 1 illustrates a guitar 10 including an electromagnetic pickup 12 embodying the invention. Except for the pickup 12 the guitar 10 is an otherwise conventional electric guitar having a solid body 14 and six strings $S_1$ to $S_6$ extending generally parallel to one another from a combined bridge and tail piece 16 to a nut 18 and head stock 20, so as to pass over the pickup 12. Each of the strings $S_1$ to $S_6$ is made at least in part of steel or other ferromagnetic material so as to be cooperable with the pickup 12 in producing output voltage signals related to the vibration of the string. An output cable 22 includes conductors for conducting the signal produced by the pickup 12 to an associated utilization system such as a sound system including amplifiers for amplifying the pickup signals and speakers driven by the amplified signals.

Figure 4:
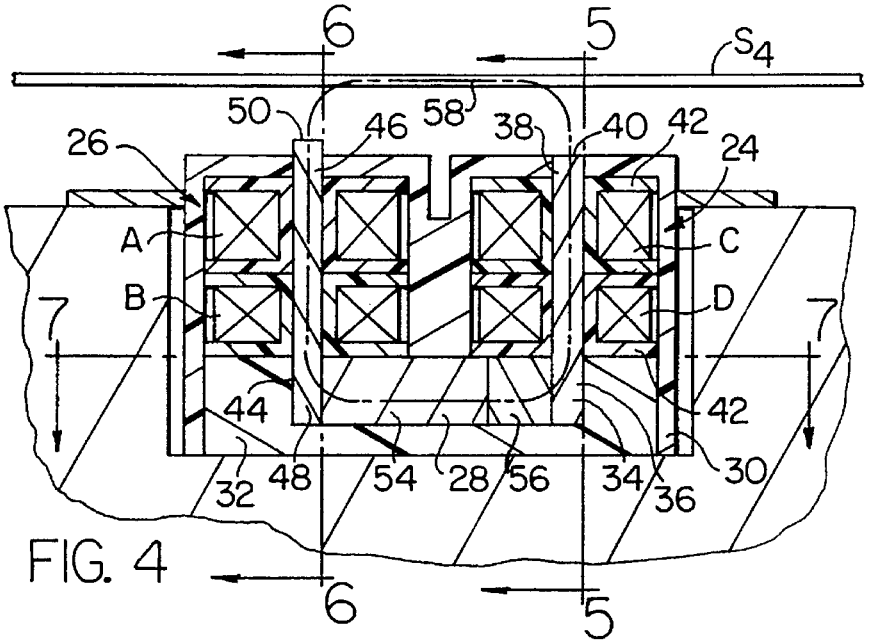
FIG. 4 is a vertical sectional view taken on the line 4—4 of FIG. 3.

The detailed construction of the pickup 12 is shown in FIGS. 2 to 9. Turning to these figures, the pickup 12 includes a first coil and core section 24, a second coil and core section 26, a permanent magnet means 28, a plastic housing 30, and plastic potting material 32, as best seen in FIG. 4.

Figure 5:
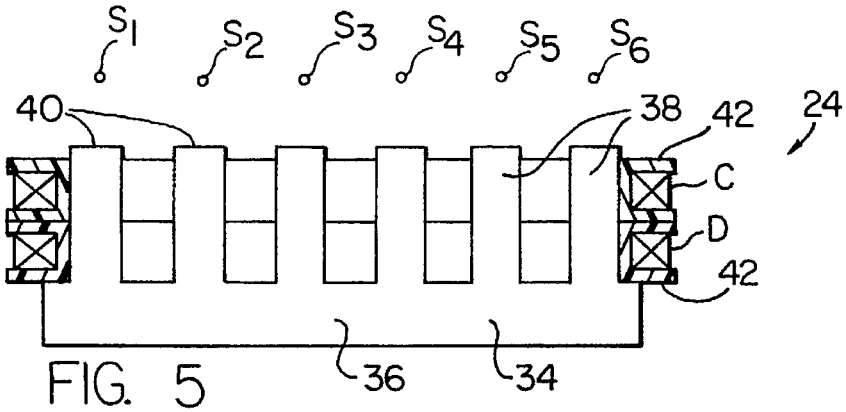
FIG. 5 is a vertical sectional view taken on the line 5—5 of FIG. 4 and showing only the blade and coils of the first coil and core section.

The first coil and core section 24, as best seen in FIG. 5 includes a core, made of steel or other ferromagnetic material, in the form of a blade 34 having a lower portion consisting of a horizontally extending strip 36 and an upper portion consisting of a plurality of teeth 38 extending upwardly from the strip 36. The teeth 38 are equal in number to the number of strings $S_1$ to $S_6$ of the guitar 10 and are spaced in conformity with the spacing of those strings so that each tooth 38 underlies a respective one of the strings. Each tooth 38 has an upwardly facing upper end surface 40, which faces are located in a common horizontal plane so that the vertical spacings between the faces 40 and the strings $S_1$ to $S_6$ are uniform. Wound around the upper portion of the blade 34, that is around the teeth 38, are two separate coils C and D, preferably of equal numbers of turns, with each coil C and D being carried by a separate plastic bobbin 42.

Figure 6:
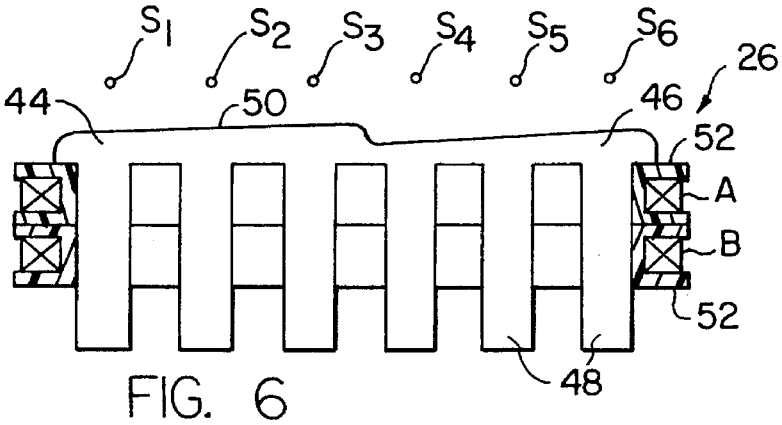
FIG. 6 is a vertical sectional view taken on the line 6—6 of FIG. 4 and showing only the blade and coils of the second coil and core section.

The second coil and core section 26, as best seen in FIG. 6, includes a core, made of steel or other ferromagnetic material, in the form of a blade 44 having an upper portion consisting of a horizontally extending strip 46 and a lower portion consisting of a plurality of teeth 48 extending downwardly from the strip 46. The teeth 48, similarly to the teeth 38 of the first blade 34, are equal in number to the number of strings $S_1$ to $S_6$ of the guitar 10 and are spaced in conformity with the spacing of those strings so that each tooth 48 underlies a respective one of the strings. The horizontally extending strip 46 has an upwardly facing upper end surface 50, which surface is of such a shape, as viewed in FIG. 6, as to cause the spacing between the surface 50 and the strings $S_1$ to $S_6$ to be non-uniform. It will be appreciated that the spacing between each string and the surface 50 influences the character of the signals generated in the coils A and B by the vibration of that string and that the shape of the surface 50 may be varied from that shown in FIG. 6 to provide for spacings between the strings and the surface 50 different from those shown in FIG. 6 to produce output signals from the coils A and B differing somewhat from the signals produced with the shape of the surface 50 shown in FIG. 6. The shape shown in FIG. 6 is, however, the presently preferred shape for the surface 50.

The permanent magnet means 28 extends between and engages the bottom portion of the blade 34 and the bottom portion of the blade 44 and applies a south magnetic polarity to one of the blades and a north magnetic polarity to the other of the blades. The permanent magnet means 28 therefore acts as a source of magnetism providing a flux circuit, such as shown by the broken line 58 of FIG. 4, for each string passing through the permanent magnet means, the associated tooth 38 of the first blade 34, the associated string and the associated tooth 48 of the second blade 44, the reluctance of which flux circuit is varied by the vibration of the string so as to induce voltages in the associated coils A, B, C and D.

Figure 7:
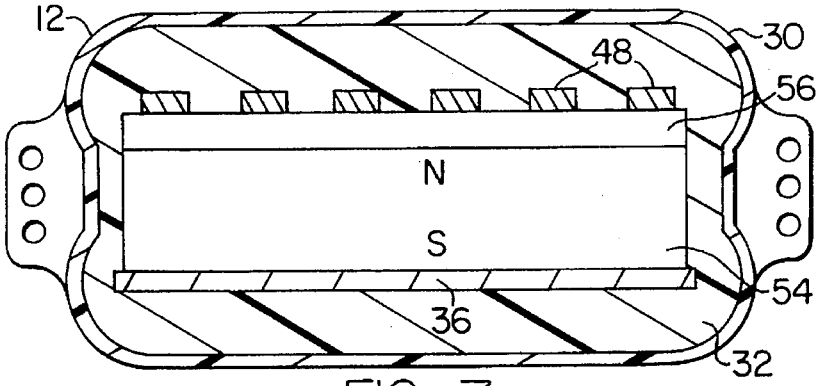
FIG. 7 is a horizontal sectional view taken on the line 7—7 of FIG. 4.
Figure 8:
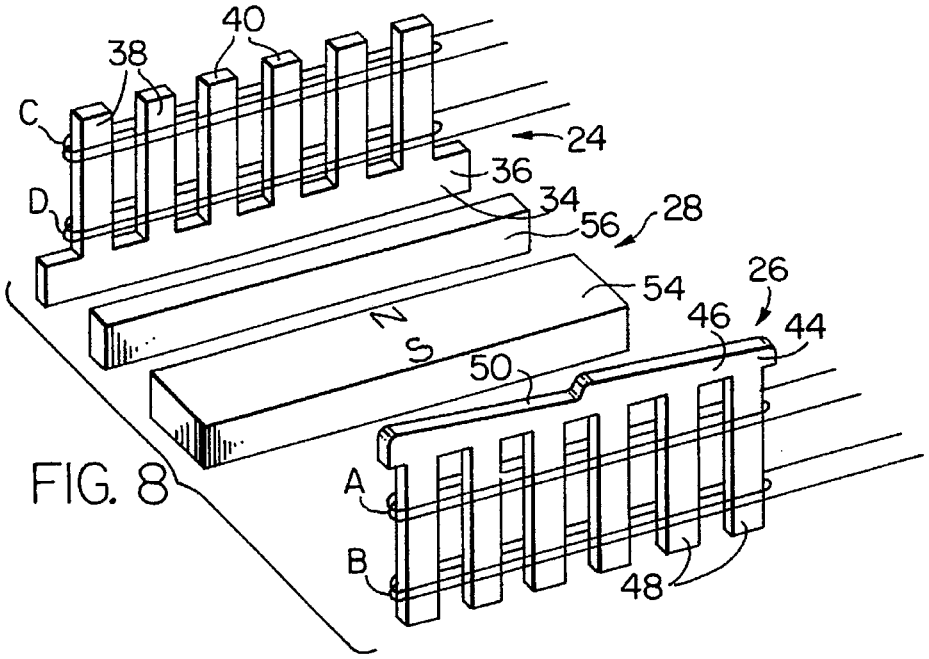
FIG. 8 is an exploded, somewhat schematic view of the coil and core sections and of the permanent magnet means of the pickup of FIG. 2.
Figure 9:
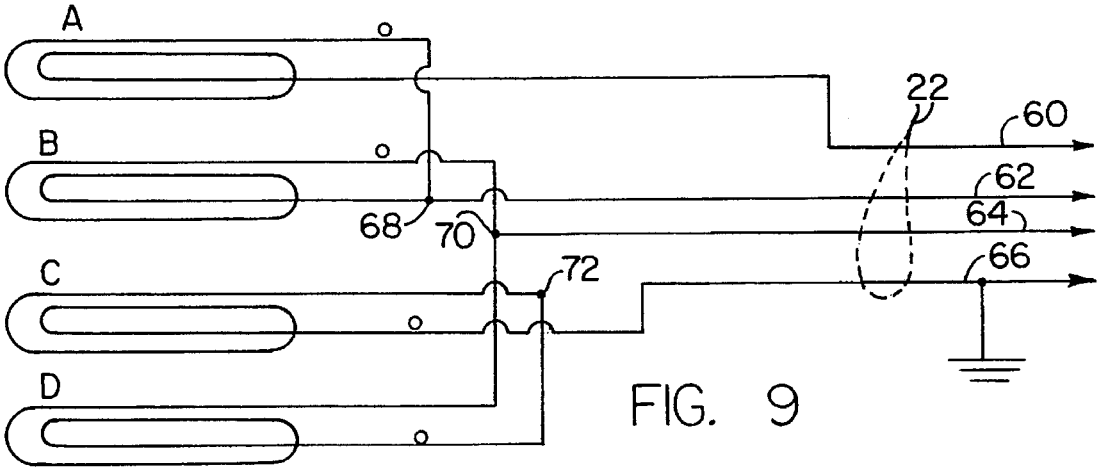
FIG. 9 is a schematic wiring diagram illustrating the connections between the coils of the pickup and the output conductors.

The actual construction of the permanent magnet means 28 may vary, but as shown in FIGS. 4, 7 and 9, it includes a permanent magnet 54 in the shape of a rectangular bar having side faces of opposite magnetic polarity, and an iron bar 56. One side face of the magnet 54 engages the lower portion of the second blade 44, the other side face of the magnet engages one side face of the iron bar 56 and the other side face of the iron bar 56 engages the lower portion of the first blade 34.

The four coils A, B, C and D are connected to one another and to four conductors, 60, 62, 64 and 66, of the output cable 22 in the way shown in FIG. 9. In this figure the dots associated with the coils indicate coil ends of similar polarity with respect to voltages induced in the coil by flux changes arising from string vibration. The coil A has one end connected to the output conductor 60 and its other end connected to one end of the coil B at a common point 68. The common point 68 is also connected to the output conductor 62. The other end of the coil B is connected to an intermediate point 70 which intermediate point is also connected to the output conductor 64. The intermediate point 70 is also connected to one end of the coil D. The other end of the coil D is connected to a common point 72 which is also connected to one end of the coil C. The other end of the coil C is connected to the output conductor 66 which is also grounded.

From FIG. 9 it will be seen that the coils A, B, C and D are connected in series with one another across the output conductors 60 and 66 with the individual voltages appearing across the individual coils being additive to one another when such voltages are produced by string vibration, it being noted that the flux circuit established by the permanent magnet means 28 moves through the teeth 38 of the first blade 34 in directions opposite to its movement through the teeth 48 of the second blade 44. In contrast to this, any stray magnetic field which may pass through the pickup 12 will essentially pass through the teeth of the two blades in the same direction and therefore the voltages induced by such stray magnetic field in the coils A and B will be in bucking relationship to the voltages induced by that field in the coils B and C so as to cancel one another and therefore not be present in the voltage signal appearing across the output conductors 60 and 66.

Also from FIG. 9 it will be observed that the combined output of the two coils A and B appears across the conductors 60 and 64, and the combined output of the coils C and D appears across the conductors 64 and 66. Further, the output voltage of the coil A by itself appears across the output conductors 60 and 62, and the output voltage of the coil B by itself appears across the conductor 62 and 64.

Therefore, a performer, as by means of suitable switches (not shown) associated with the output conductors can select from a number of different options the particular output voltage used as the feed to the associated sound system or other utilization system.

I claim:

1. An electromagnetic pickup for use with a musical instrument having a plurality of strings, said pickup comprising:

first and second elongate blades of ferromagnetic material arranged respectively in two generally parallel vertical planes, each of said blades having two oppositely facing vertical side faces, an upper portion, a lower portion, and a plurality of vertically extending teeth horizontally spaced from one another and connected to one another by a horizontally extending strip forming at least part of one of said upper and lower portions of the blade, said teeth of each of said first and second blades being equal in number to the number of strings of the musical instrument with which the pickup is to be used and being spaced from one another in conformity with the spacing of said strings from one another, a permanent magnet means located between and engaging the lower portions of said first and second blades, said permanent magnet means being of one magnetic polarity adjacent to said first blade and of the opposite magnetic polarity adjacent said second blade, a first coil means surrounding the upper portion of said first blade and a second coil means surrounding said upper portion of said second blade.

2. An electromagnetic pickup as defined in claim 1, wherein:

said horizontally extending strip of said first blade forms at least part of said bottom portion of said first blade with said teeth of said first blade extending upwardly from said horizontal strip of said first blade, and said horizontal strip of said second blade forms at least a part of said upper portion of said second blade with said teeth of said second blade extending downwardly from said horizontal strip of said second blade.

3. An electromagnetic pickup as defined in claim 2, wherein:

said teeth of said first blade have upper end faces adapted to each underlie a respective one of the strings of the musical instrument with which the pickup is used, said upper end faces of said teeth of said first blade being located in a common horizontal plane so that the vertical spacings between said strings and said upper end faces are uniform.

4. An electromagnetic pickup as defined in claim 3, wherein:

said elongated strip of said second blade has an upper face adapted to underlie all of the strings of the musical instrument with which the pickup is used, said upper face of said elongated strip of said second blade being of such shape that the vertical spacings between said strings and said upper face of said elongated strip of said second blade are non-uniform.

5. An electromagnetic pickup for a stringed musical instrument as defined in claim 4, and further comprising:

two output conductors, and means connecting said first coil means in series with said second coil means between said two output conductors such that in respect to the voltage appearing across said two output conductors the voltage signals induced in said first and second coil means by magnetic flux changes caused by the vibrations of the strings of the associated musical instrument are in series aiding relationship to one another and so that the voltages induced in said first and second coil means by stray magnetic fields are in series bucking relationship to one another.

6. An electromagnetic pickup for a stringed musical instrument as defined in claim 4, and further comprising:

first, second and third output conductors, means connecting said first coil means and said second coil means in series with one another across said first and second output conductors so that in respect to the voltage appearing across said first and second output conductors the voltages induced in said first and second coil means by the vibrations of the strings of the associated musical instrument are in series aiding relationship to one another, with said first coil means and said second coil means being connected to one another at an intermediate point between said first and second conductors, and means connecting said third conductor to said intermediate point so that the voltage induced in said first coil means appears across said first and third conductors and so that the voltage appearing across said second coil means appears across said second and third conductors.

7. An electromagnetic pickup for a stringed musical instrument as defined in claim 6, wherein:

said first coil means comprises two separate coils surrounding the upper portion of said first blade, said second coil means comprises two separate coils surrounding said upper portion of said second blade, said two coils of said first coil means being connected in series with one another across said first and third conductors with two ends of said coils being connected to one another at a first common point, said two coils of said second coil means being connected in series with one another between said second and third conductors with two ends of said two coils being connected to one another at a second common point, and further comprising a fourth output conductor, and means connecting said fourth conductor to one of said common points.

* * * * *